US011541276B2

(12) United States Patent
Lin

(10) Patent No.: US 11,541,276 B2
(45) Date of Patent: Jan. 3, 2023

(54) LOWER LIMB EXERCISE DEVICE AND METHOD OF USING THEREOF

(71) Applicant: Jun Tao Lin, Rosemead, CA (US)

(72) Inventor: Jun Tao Lin, Rosemead, CA (US)

(73) Assignee: Jun Tao Lin, Rosemead, CA (US)

( * ) Notice: Subject to any disclaimer, the term of this patent is extended or adjusted under 35 U.S.C. 154(b) by 51 days.

(21) Appl. No.: 17/105,246

(22) Filed: Nov. 25, 2020

(65) Prior Publication Data

US 2022/0161090 A1 May 26, 2022

(51) Int. Cl.
*A63B 23/04* (2006.01)
*A63B 21/00* (2006.01)
(Continued)

(52) U.S. Cl.
CPC ..... *A63B 23/0488* (2013.01); *A63B 21/068* (2013.01); *A63B 21/4015* (2015.10); *A63B 21/0552* (2013.01); *A63B 2208/0204* (2013.01)

(58) Field of Classification Search
CPC ..... A63B 21/00043; A63B 21/00058–00065; A63B 21/00181; A63B 21/02–027; A63B 21/0407; A63B 21/045–0455; A63B 21/05–0557; A63B 21/4011–4015; A63B 21/4033–4034; A63B 23/04; A63B 23/0417; A63B 23/0482–0488; A63B 2023/006; A63B 2208/0204; B62M 1/18; B62M 1/20; B62M 1/24; B62M 1/28; A63G 15/00–04; A63G 13/00–10; A63G 19/00–18; A61H 1/02; A61H 1/0237; A61H 1/024; A61H 1/0244; A61H 2001/0248; A61H 2001/0521; A61H 2201/0107; A61H 2201/0157; A61H 2201/12; A61H 2201/1253; A61H 2201/1261; A61H 2201/16; A61H 2201/1628; A61H 2201/164; A61H 2201/1642; A61H 2201/1645; A61H 2201/1647; A61H 2201/1676; A61H 2201/1666; A61H 2203/04; A61H 2203/0406; A61H 2205/088; A61H 2205/10; A61H 2205/106; A61H 2205/108; E06C 1/397; E06C 1/14–22; E06C 1/30
See application file for complete search history.

(56) References Cited

U.S. PATENT DOCUMENTS 1,237,969 A * 8/1917 Stocks ..... B62K 3/002 280/251
1,276,587 A * 8/1918 Spaulding ..... B62M 1/28 280/251

(Continued)

FOREIGN PATENT DOCUMENTS

WO WO-2010082132 A1 * 7/2010 ..... A63B 22/20

*Primary Examiner* — Garrett K Atkinson
*Assistant Examiner* — Kathleen M Fisk

(57) ABSTRACT

The present application discloses a standing vertical lower limb exercise device. The lower limb exercise device includes two major pivotal members, a horizontal bridge member that connects the major pivotal members, a stretchable spring, a string member for limiting a split angle formed by the two major pivotal members, and wheels, gears, and shafts to facilitate movement of the two major pivotal members. The stretchable spring and string member are coupled between the two major pivotal members. Wheels are coupled to each major pivotal member.

2 Claims, 6 Drawing Sheets

(51) Int. Cl.
*A63B 21/068* (2006.01)
*A63B 21/055* (2006.01)

(56) References Cited

U.S. PATENT DOCUMENTS 1,440,088 A * 12/1922 Kroher ..... A63G 19/02 280/1.182
1,561,639 A * 11/1925 Edgar ..... A63G 19/14 280/1.183
1,991,782 A * 2/1935 Bloomquist ..... B62M 1/18 280/1.181
2,015,974 A * 10/1935 Stannard ..... A63G 19/02 280/1.181
2,017,213 A * 10/1935 Laborda ..... A63G 19/02 280/1.188
2,476,915 A * 7/1949 Romero ..... A63G 19/10 280/1.182
2,635,886 A * 4/1953 Schoebel ..... A63G 19/02 280/1.183
2,978,258 A * 4/1961 Gabrielson ..... A63G 19/02 280/1.182
3,096,990 A * 7/1963 Thoren ..... A63G 19/14 280/1.182
3,229,995 A * 1/1966 Grieder ..... A63G 19/02 280/1.183
4,456,247 A * 6/1984 Ehrenfried ..... A61H 1/0244 482/136
4,531,730 A * 7/1985 Chenera ..... A63B 23/03516 482/142
4,650,187 A * 3/1987 Chenera ..... A63B 23/0488 482/145
4,693,466 A * 9/1987 Swengel, Sr. ..... A63G 13/08 472/105
4,844,453 A * 7/1989 Hestilow ..... A61H 1/0244 482/131
4,877,239 A * 10/1989 Dela Rosa ..... A61H 1/0244 482/131
5,026,049 A * 6/1991 Goodman ..... A63B 21/4047 482/131
5,137,504 A * 8/1992 Mangini ..... A61H 1/0244 482/133
5,222,928 A * 6/1993 Yacullo ..... A63B 69/0057 482/71
5,306,218 A * 4/1994 Huang Chen ..... A63B 22/0076 280/1.182
5,674,164 A * 10/1997 Kravitz ..... A63B 21/0004 482/121
5,904,641 A * 5/1999 Huang ..... A61H 1/0244 482/133
6,010,433 A * 1/2000 Chao ..... B62M 1/28 482/57
6,234,935 B1 * 5/2001 Chu ..... A63B 21/00069 482/71
6,352,495 B1 * 3/2002 Hsu ..... A61H 1/0244 482/92
6,746,383 B2 * 6/2004 Yu ..... A63B 21/153 482/123
7,108,645 B2 * 9/2006 Lincoln ..... A63B 23/0488 482/142
7,314,431 B1 * 1/2008 Korotiaev ..... A63B 23/0488 482/92
7,340,786 B1 * 3/2008 Smith ..... A61H 1/0244 482/133
7,485,078 B1 * 2/2009 Chen ..... A63B 22/20 482/136
7,789,806 B2 * 9/2010 Yang ..... A63B 22/001 482/66
7,798,943 B1 * 9/2010 Tsai ..... A63B 22/0005 482/121
7,959,544 B2 * 6/2011 Palmer ..... A63B 22/0061 482/130
8,858,410 B2 * 10/2014 Piane, Jr. ..... A63B 7/00 482/66
9,901,507 B2 * 2/2018 Banus Ricoma ..... A61H 1/02
10,172,758 B1 * 1/2019 Downs ..... A61H 1/0237
11,154,139 B2 * 10/2021 Ge ..... A63B 21/068
2003/0207741 A1 * 11/2003 Yu ..... A63B 21/00069 482/121
2007/0114749 A1 * 5/2007 Tal ..... B62K 3/002 280/221
2010/0004103 A1 * 1/2010 Yang ..... A63B 22/001 482/132
2010/0190621 A1 * 7/2010 Palmer ..... A63B 22/0061 482/121
2011/0172071 A1 * 7/2011 Piane, Jr. ..... A63B 21/169 482/142
2014/0187395 A1 * 7/2014 Blahnik ..... A63B 23/1236 482/141
2014/0338583 A1 * 11/2014 Xin ..... A63B 35/10 114/315
2017/0281451 A1 * 10/2017 Banus Ricoma ..... A61H 1/02
2017/0354842 A1 * 12/2017 Boland ..... A63B 21/0023
2019/0038034 A1 * 2/2019 Ge ..... A47C 9/002

* cited by examiner

LOWER LIMB EXERCISE DEVICE AND METHOD OF USING THEREOF

FIELD OF THE PRESENT INVENTION

The invention relates to a fitness equipment that allow user to exercise inner and outer thigh muscle group with assisted force and user adjustable movement range. The exercise equipment of the present invention provides ease of use and spacing saving advantages which is suitable of use in commercial gym and at home.

BACKGROUND OF THE PRESENT INVENTION

Traditional fitness equipment for exercising inner and outer thigh muscle group found in common gym were large and not as user friendly. A typical inner and outer thigh exercise equipment in gym normally consists of added weight stack system and it occupies a large space due to its horizontal leg movement. These traditional inner and outer thigh exercise equipment have a steep learning curve because it requires device setting between inner thigh exercise movement and outer thigh exercise movement. Hence, the traditional inner and outer thigh fitness equipments are likely to be found in commercial gym where trainers or equipment instructors are assessable, but they are not common at home.

The present invention provides a novel device for performing inner and outer thigh exercises without requiring switching setting between inner thigh exercise and outer thigh exercise; it provides assisted force with intuitive adjustment for assistive force feedback and this invention does not require added weight system; therefore, it is small in foot print compare to traditional inner and outer thigh fitness equipment and it is portable that can be used on common flat surface such in commercial gym or at home.

SUMMARY OF THE INVENTION

The present invention provides a novel device and method for performing inner and outer thigh exercise, which guided and assisted the user to exercise the inner and outer thigh muscle in standing position with settings of multiple level of assisted force and opening range defined by the user.

In one aspect of the invention, there is a provided device comprising two major pivotal members of the device which are connected through a center bridge by axils and gear set; the two major pivotal members have a palm like symmetry of left and right and they can rotate reference to vertical center symmetry line with a same rotational speed but opposite direction. There are two footers attached to each of the major pivotal member that allows the user to stand on the device. A wheel system is installed to each major pivotal member of the device, which allows the device to be used on a flat surface.

In another preferred embodiment, the above said wheel system mainly consists but not limited to two wheels, two axles and two miter gears. The two wheels are locked to a horizontal axle which is parallel to the ground with a miter gear is installed on to the horizontal wheel axle. Another axle that has the same type of miter gear installed connects to the horizontal wheel axle perpendicularly through the miter gear set. Since the two pivotal members are palm like symmetry, the above-described wheel systems are also in a palm like symmetry. One pivotal member has a wheel system installed and the other pivotal member has the other palm like symmetry wheel system installed. The wheel systems are connected by a flexible shaft located in the middle of the device. Hence, these two systems are locked together which the wheel speed of the wheel system on one side is always equal to the wheel speed on the other side of the pivotal member reference to the ground; and the direction of wheel rotation reference to the ground of the wheel system on one side is always opposite to the wheel system on the other side. The combine effect makes the device self located at one working location during exercise without its symmetry center line moving reference to the ground.

In another preferred embodiment, one or more spring element is attached to the device which one end of the element is fixed on one pivotal member and the other end of the element is fixed on the other pivotal member. The spring element stores the potential energy released during the outer thigh exercise movement and returns the potential energy back in the form of assisted force during inner thigh exercise.

In another preferred embodiment, one or more string element is attached to the device which one end of the element is fixed on one pivotal member and the other end of the element is fixed on the other pivotal member. The opening range of the pivotal members is controlled and limited by the string element.

BRIEF DESCRIPTION OF THE DRAWINGS

These and other features of the invention will become apparent from the following description in which reference is made to the appended drawings wherein.

DETAILED DESCRIPTION

Figure 1:
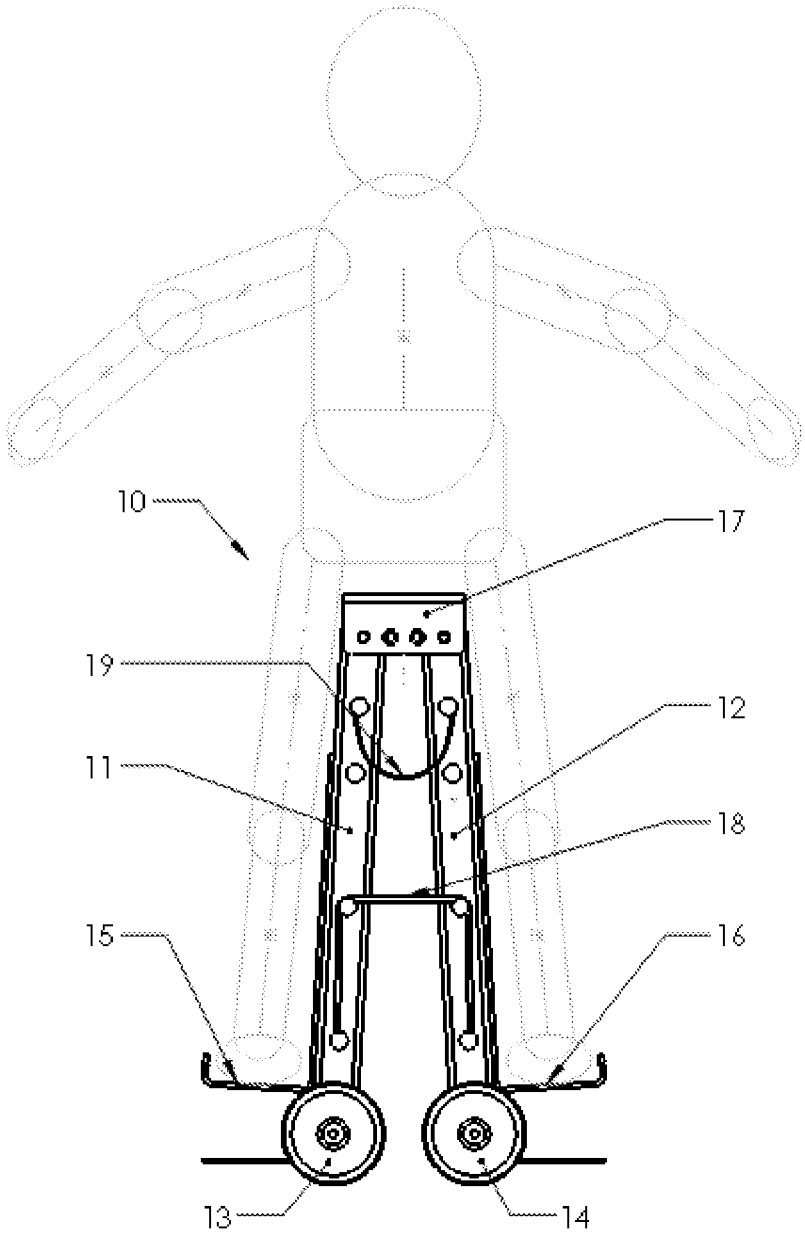
FIG. 1 illustrates an embodiment of the inner and outer thigh exercise equipment of the present invention in the major pivotal member at close configuration.
Figure 2:
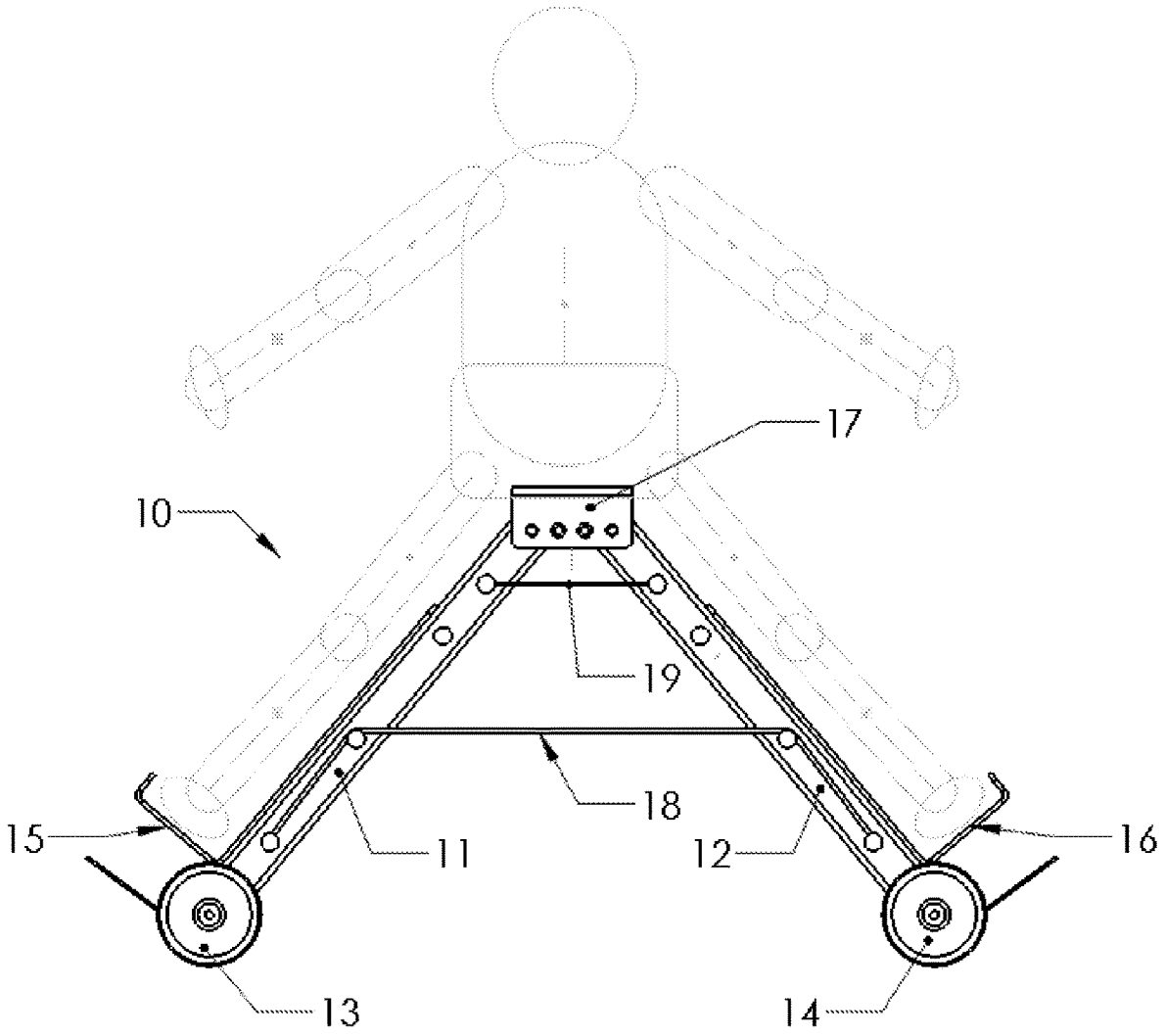
FIG. 2 illustrates the embodiment of the inner and outer thigh exercise equipment of the present invention in the major pivotal member at open configuration.

The present invention provides a novel device for the inner and outer thigh exercise where FIG. 1 shows the device in close configuration and FIG. 2 shows the device in split open configuration. The user performs inner and outer thigh exercise movement in between these two configurations.

Preferred embodiments of an exercise device according to the invention are described below with reference to the attached drawings.

Figure 3:
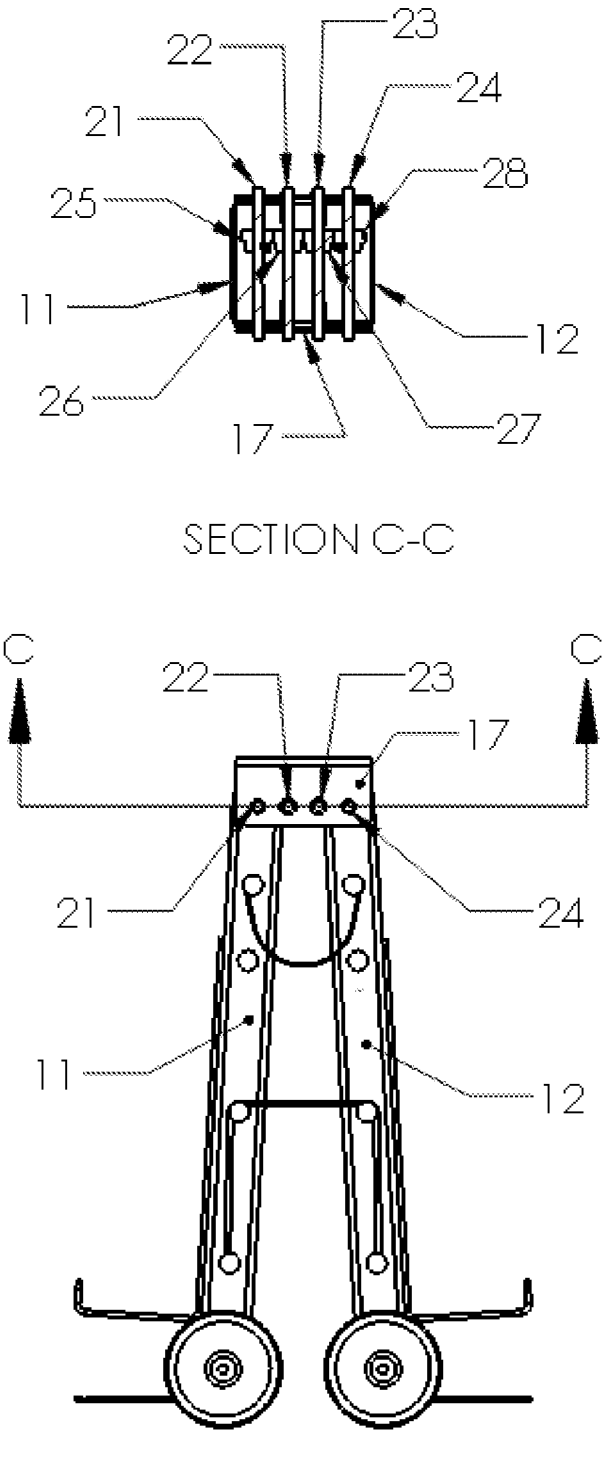
FIG. 3 illustrates the embodiment of the two major pivotal members' connection system.

FIG. 1 illustrates one embodiment of the invention. In this embodiment the device 10 comprises two major member 11 and 12; member 11 connects to member 12 through the a bridge member 17 and a set of gear system under member 17 as shown in FIG. 3; where shaft 21 is locked on to member 11 and rotates freely on 17, gear 25 is locked on to shaft 21, gear 26 is locked on to shaft 22, gear 27 is locked on to shaft 23, gear 28 is locked on to shaft 24 and shaft 24 that rotates freely on 17 is locked on to member 12. Gear 25 meshes with gear 26, gear 26 meshes with gear 27 and gear 27 meshes with gear 28; therefore, rotation of gear 25 can be transferred to gear 28 in a ratio of 1:1 but opposite rotational direction. As a result, the internal angle formed by member 11 and member 17 is always equal to the internal angle formed by member 12 and member 17 during movement; the motion of member 11 referencing to member 17 is forced to mirror the motion of member 12 referencing to member 17.

Figure 4:
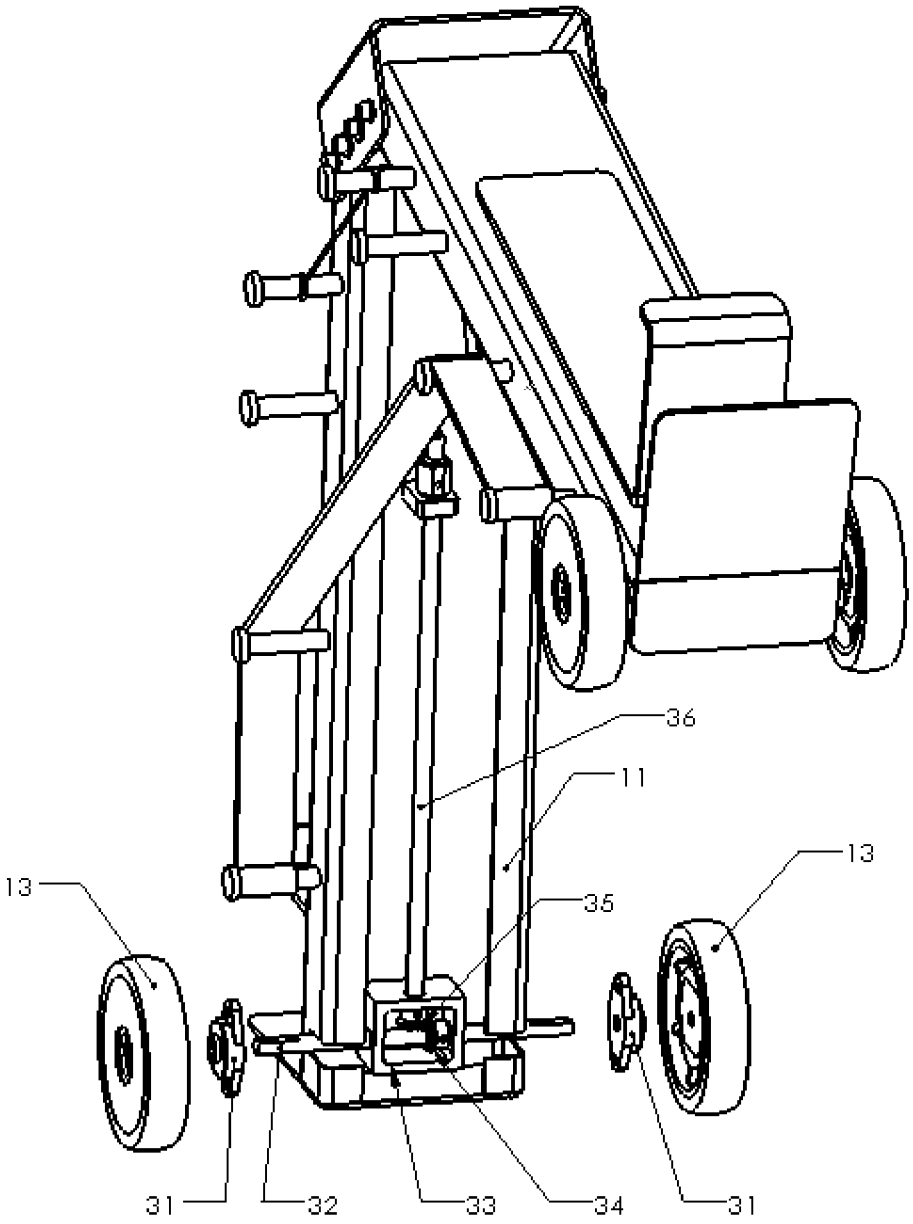
FIG. 4 illustrates one of the wheel system of the device.

FIG. 4 is an exploded view of the two-wheel system, and it illustrates one of embodiment of two-wheel system which is installed on member 11. The two-wheel system consists of two wheels of 13 which is locked on to each end of shaft 32; gear 34 is locked on to shaft 32 where enclosed by housing 33; and shaft 32 is support by two bearings of 31 which is mounted on member 11. Gear 35 is locked on to shaft 36 and gear 35 meshes to gear 34; both gear 34 and 35 are enclosed by housing 33. Rotational motion of shaft 32 can be transferred to shaft 36 by gear 34 and 35.

Figure 5:
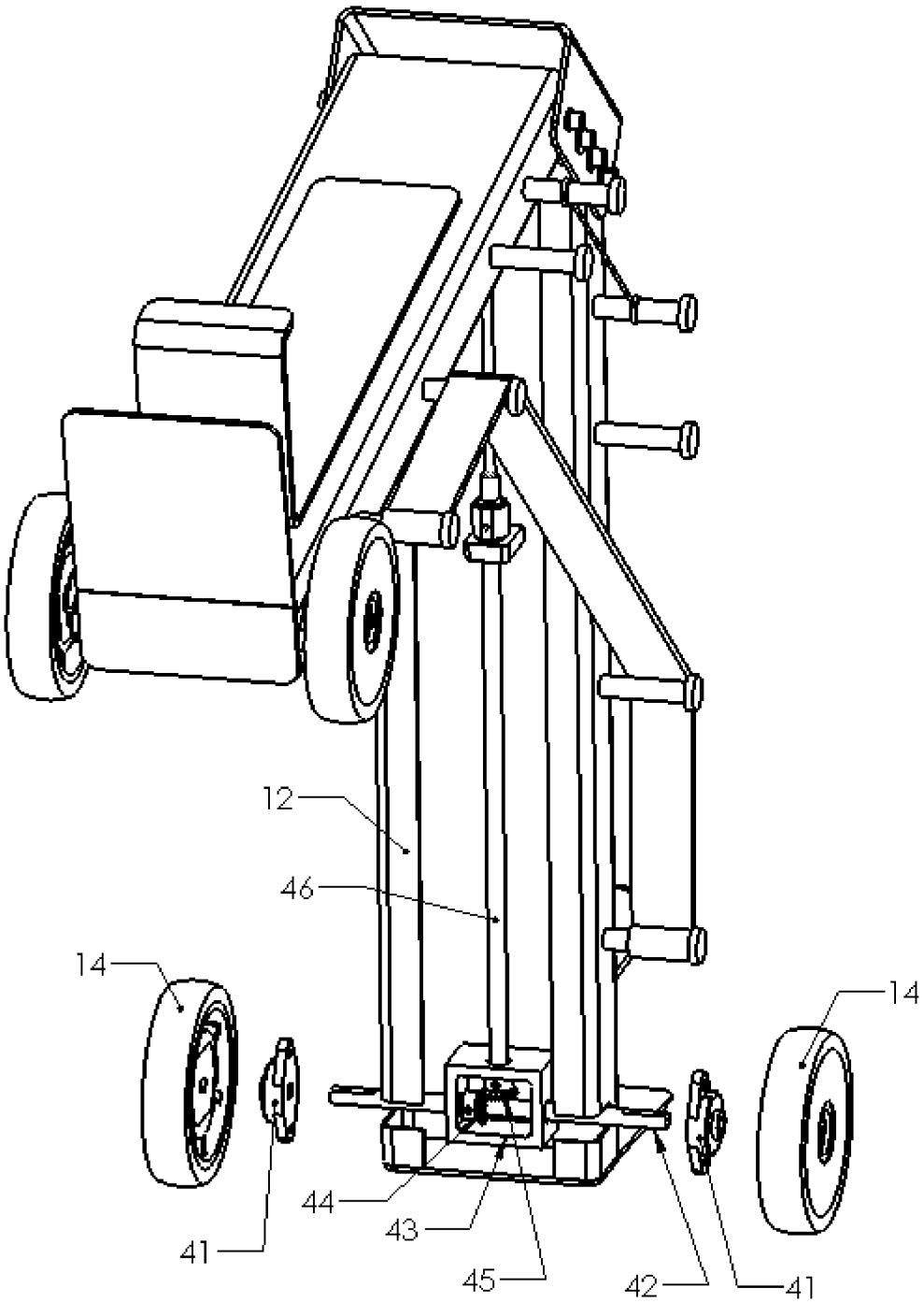
FIG. 5 illustrates one of the wheel system of the device.

FIG. 5 is an exploded view of the two-wheel system, and it illustrates one of embodiment of two-wheel system which is installed on member 12. The two-wheel system consists of two wheels of 14 which is locked on to each end of shaft 42; gear 44 is locked on to shaft 42 where enclosed by housing 43; and shaft 42 is support by two bearings of 41 which is mounted on member 12. Gear 45 is locked on to shaft 46 and gear 45 meshes to gear 44; both gear 44 and 45 are enclosed by housing 43. Rotational motion of shaft 42 can be transferred to shaft 46 by gear 44 and 45.

Figure 6:
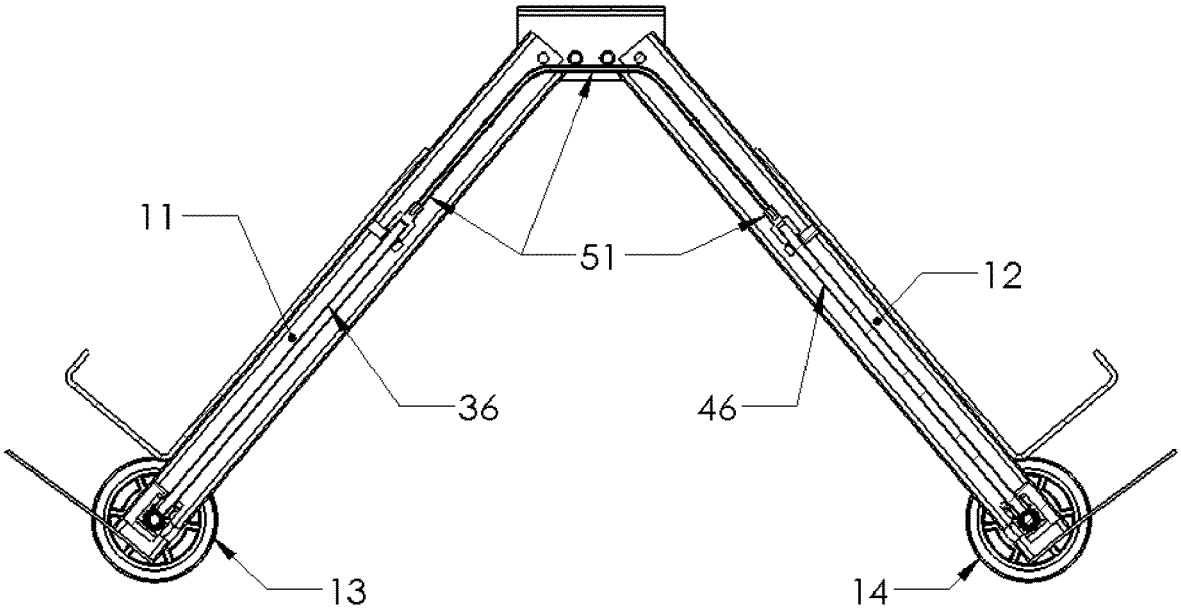
FIG. 6 illustrates a cross section view of the device.

FIG. 6 is a cross section of the device 10 and it illustrates how the two-wheel system installed on member 11 connects to the other two-wheel system that is installed on member 12. The shaft 36 is connected to flexible shaft 51 and shaft 51 is connected to shaft 46; hence, the two two-wheel systems are locked on to each other through shaft 51. The rotational motion speed of the wheel 13 on the side of member 11 can be transferred to wheel 14 on the other side of member 12 at a ratio of 1:1 in the reference to the ground while the directional of rotation of wheel 13 is opposite of the direction of rotation of wheel 14 reference to the ground. The result of this arrangement of wheel systems allows device 10 be stationary reference to the ground while the user performing inner and outer thigh exercise; this means members of device 10 is in motion during exercise but device 10's relative location to the ground will be still.

In FIG. 1, one end of member 18 that has spring like property is fixed on to member 11 and the other end of member 18 is fixed on to member 12. During the outer thigh exercise shown in FIG. 2, member 18 is stretched; the elongation of member 18 absorbs potential energy released by the user's exercise movement which in term provides the resistance force for the outer thigh exercise. On the other hand, during the inner thigh exercise, member 18 that was elongated at the end of the outer thigh exercise will provide a tension to help the user to pull up its center of mass reference to the ground. The combine effect of this arrangement allows the user to have an assisted force during the inner and outer thigh exercise. By fitting device 10 with different spring rate of member 18, the assisted forces can compensate different user's requirement.

In FIG. 1, one end of member 19 which as a fixed length is fixed on to member 11 and the other end of member 19 is fixed on to member 12. During the outer thigh exercise shown in FIG. 2, member 19 is pulled to its fixed length; therefore, member 19 limits the split angle formed by member 11 and 12. By fitting device 10 with different length of member 19, user can adjust the maximum split angle during the inner and outer thigh exercise.

In FIG. 1 and FIG. 2, a first footrest 15 and a second footrest 16 are provided on the two major pivotal members 11, 12.

What is claimed is:

1. An inner and outer thigh exercise device configured to allow a user to perform standing up vertical inner and outer thigh exercises, comprising:

two major pivotal members;

a bridge member connecting the two major pivotal members;

a first footrest and a second footrest respectively coupled to the two major pivotal members;

a string member coupled between the two major pivotal members and configured to limit a split angle of the two major pivotal members;

a spring member coupled between the two major pivotal members and configured to store potential energy in the form of tension when the user's center of mass is lowering towards a ground during the outer thigh exercise and release the stored potential energy when the user's center of mass is raising away from the ground during the inner thigh exercise;

a two-wheel system installed on each of the two major pivotal members, each two-wheel system comprising two wheels connected by a shaft, wherein the two-wheel systems of the two major pivotal members are connected to one another by a flexible shaft extending between the two major pivotal members; and a gear system comprising a plurality of gears respectively locked on a plurality of shafts positioned under the bridge member and connected to the two major pivotal members to control a motion of the two major pivotal members such that the motion of one of the two major pivotal members mirrors the motion of the other of the two major pivotal members.

2. The inner and outer thigh exercise device of claim 1, wherein each of the two-wheel systems and the gear system are configured such that the wheels on the two major pivotal members rotate at the same speed in opposing rotational directions with reference to the ground and move towards or away from a sagittal plane of the user when the user performs the inner and outer thigh exercises.

* * * * *